US005167314A

United States Patent [19]

Levasseur

[11] Patent Number: 5,167,314

[45] Date of Patent: Dec. 1, 1992

[54] COIN GUIDING DEVICE

[75] Inventor: Joseph L. Levasseur, Chesterfield, Mo.

[73] Assignee: Coin Acceptors, Inc., St. Louis, Mo.

[21] Appl. No.: 653,015

[22] Filed: Feb. 8, 1991

Related U.S. Application Data

[63] Continuation-in-part of Ser. No. 365,178, Jun. 12, 1989, Pat. No. 5,040,658, which is a continuation-in-part of Ser. No. 233,887, Aug. 16, 1988, Pat. No. 4,838,406, which is a continuation of Ser. No. 922,830, Oct. 22, 1986, abandoned, which is a continuation of Ser. No. 659,368, Oct. 10, 1984, abandoned.

[51] Int. Cl.[5] ..... G07D 3/00

[52] U.S. Cl. ..... 194/346; 453/3

[58] Field of Search ..... 194/346, 230, 231; 453/3, 5, 9, 15; 379/149, 150, 151

[56] References Cited

U.S. PATENT DOCUMENTS

| | | | |
|---|---|---|---|
| 2,642,974 | 6/1953 | Ogle | 194/346 X |
| 3,916,922 | 11/1975 | Prumm | 453/3 |
| 4,228,811 | 10/1980 | Tanaka et al. . | |
| 4,361,161 | 11/1982 | Johnson | 194/346 X |
| 4,437,558 | 3/1984 | Nicholson . | |
| 4,465,173 | 8/1984 | Domen . | |
| 4,720,004 | 1/1988 | Voegeli | 194/202 |
| 4,838,406 | 6/1989 | Levasseur | 194/346 |

FOREIGN PATENT DOCUMENTS

| | | | |
|---|---|---|---|
| 625214 | 2/1936 | Fed. Rep. of Germany | 194/346 |
| 2111737 | 7/1983 | United Kingdom | 194/346 |

*Primary Examiner*—F. J. Bartuska
*Attorney, Agent, or Firm*—Cohn, Powell & Hind

[57] ABSTRACT

This coin guiding device (10) includes a coin delivery passage (12), three coin discharge passages (38, 62, and 64). A pivoted gate (24) is disposed in the coin delivery passage (12) having a coin guiding upper edge (32) and opposed coin guiding faces (34 and 36). A gate actuator (M1) selectively moves the gate (24) a first position in which the gate upper edge (32) guides a coin into the first discharge passage (38), a second position in which one of the opposed faces (34) guides a coin into the second discharge passage (62) and a third position in which the other opposed face (36) guides a coin into the third discharge passage (64). In one embodiment a second, similar gate (132) is disposed in first discharge passage (38) for further directing a coin in one of three directions.

18 Claims, 5 Drawing Sheets

FIG. 8.
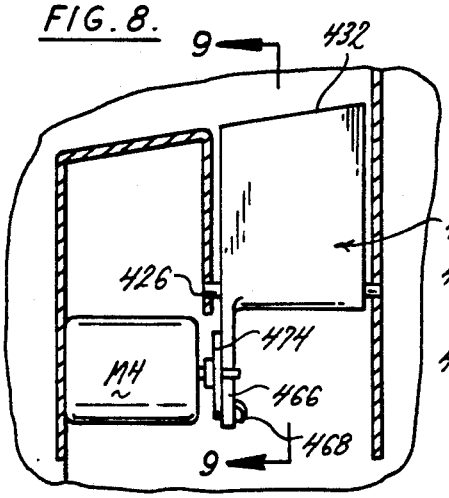
FIG. 9.
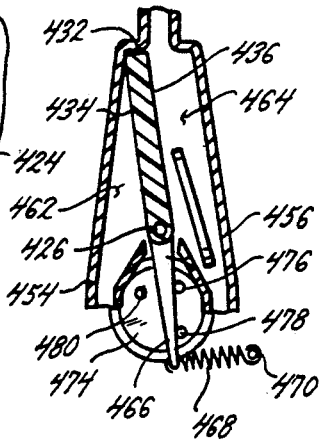
FIG. 10.
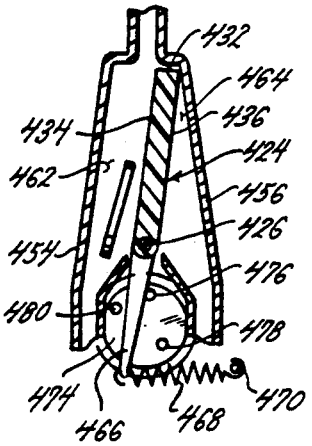
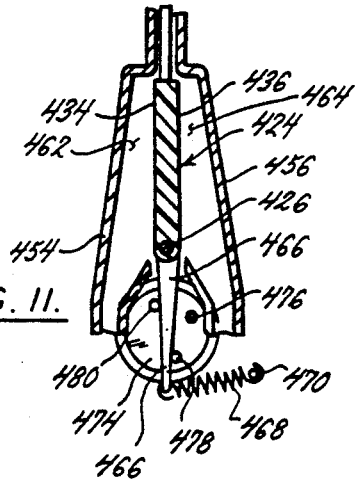
FIG. 11.
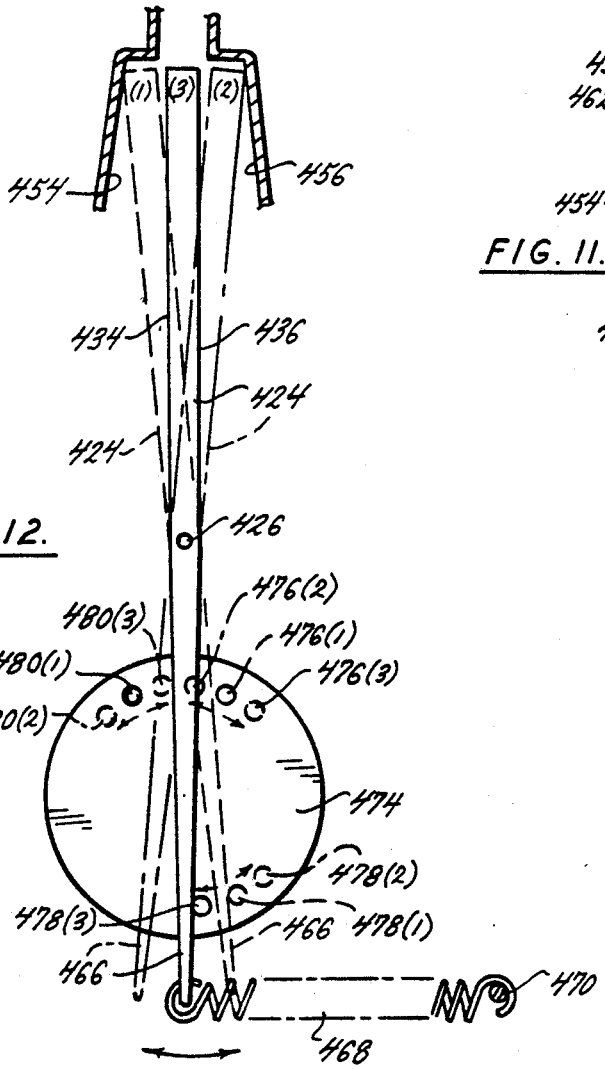
FIG. 12.

COIN GUIDING DEVICE

RELATED U.S. APPLICATION DATA

Continuation-in-part of U.S. Ser. No. 365,178, Jun. 12, 1989, now U.S. Pat. No. 5,040,658, Aug. 20, 1991; which is a continuation-in-part of Ser. No. 233,887, Aug. 16, 1988, U.S. Pat. No. 4,838,406, Jun. 13, 1989; which is a continuation of Ser. No. 922,830, Oct. 22, 1986, abandoned, which is a continuation of U.S. Ser. No. 659,368, Oct. 10, 1984, abandoned.

BACKGROUND OF THE INVENTION

This invention relates generally to coin handling devices and particularly to a coin guiding device having a movable element disposed in a coin path for guiding the coin into one of three selected paths.

Coin guiding devices which include a movable element disposed in a coin path for guiding the coin into one of three selected paths are known in the prior art. The device believed to be the most pertinent is that disclosed in U.S. Pat. No. 4,503,961. This patent reveals a pivoted gate disposed in a coin path and having a central passage and opposed side faces. The gate is movable from a vertical working position, in which a coin is directed through the central passage, to one of two angled positions in which a coin is deflected by one or the other side face into one of two alternative paths. While this device has the versatility of directing coins into three different paths it lacks the capability of directing a coin into a path transverse to the original path. In addition, it must utilize a gate sufficiently thick to provide a through passage which is space-consuming in an environment where space is at a premium.

The present invention solves these and other problems in a manner not revealed in the known prior art.

SUMMARY OF THE INVENTION

This invention provides a coin handling device which can guide a coin into one of three different paths utilizing a single movable element.

The movable element is narrow and minimizes space requirements while permitting considerable versatility in direction of movement of the guided coin. In addition, the movable element can be used in tandem with like movable elements positioned downstream to further guide and sort the coins.

It is an aspect of this invention to provide a coin guiding device comprising a coin delivery path; first, second and third coin discharge paths, a movable element disposed in the coin delivery path and having a coin guiding upper edge and opposed coin guiding faces, and actuating means for selectively moving said movable element between a first position in which the upper edge guides a coin into the first discharge path, a second position in which one of said opposed faces guide a coin into the second discharge path and a third position in which the other of said opposed faces guides a coin into said third discharge path.

It is another aspect of this invention to provide that the movable element is a hinged gate means having pivot means.

It is yet another aspect of this invention to provide that the actuating means includes a reversible electric motor operatively connected to said gate to pivot said gate means about said pivot means, and still another aspect to provide that the actuating means includes solenoid means.

One aspect of this invention is to provide that the actuating means includes biasing means operatively connected to said gate to maintain said gate means in one of said first, second and third positions.

Another aspect of this invention is to provide that said gate means includes a lever arm and said actuating means includes moving means and means operatively connecting said lever arm to the moving means for moving said gate means and still another aspect is to provide that the lever arm is a bell crank.

Still another aspect of this invention is to provide that the reversible electric motor shaft means includes at least one offset lug portion operatively engageable with said gate means and providing said connecting means between the gate means and the moving means.

It is an aspect of this invention to provide that the actuating means includes an electric motor means and a plurality of pins offset from the axis of rotation of the motor means, said pins being selectively engageable with said gate means to move said gate means between said first, second and third positions.

Yet another aspect of this invention is to provide that the actuating means includes an electric motor and cam means between said electric motor and said gate means for moving said gate means between said first, second and third positions.

Still another aspect of this invention is to provide that the cam means includes a cam mounted for rotation with said motor and a cam follower operatively attached to said gate means.

In another aspect of this invention the cam includes a face provided with a cam groove and the cam follower is a pin attached to said gate means in spaced relation to said pivot means and received by said groove.

In still another aspect of this invention the cam groove includes ends engageable by said pin to provide stop means limiting movement of said gate means.

In one aspect of this invention the cam face is flat and is provided by a disc rotatable by the motor means, and in another aspect the cam face is arcuate and is provided by a cylinder rotatable by the motor.

In another aspect of this invention the coin paths include wall portions providing stop means limiting movement of said gate means.

Yet another aspect of this invention is to provide a second movable element disposed in one of said discharge paths and having a coin guiding upper edge and opposed coin guiding faces.

It is an aspect of this invention to provide a coin guiding device which is simple and inexpensive to manufacture and highly efficient in operation.

BRIEF DESCRIPTION OF THE DRAWINGS:

FIG. 8 is a fragmentary view of another modified coin guiding device;

FIG. 9 is a cross sectional view taken on line 9—9 of FIG. showing the gate in a neutral position;

FIG. 10 is a similar view to FIG. 9 showing the gate in another position;

FIG. 11 is a similar view to FIG. 9 showing the gate in another position.

FIG. 12 is an enlarged schematic view showing the operating positions of the gate of FIGS. 8-11;

Figure 1:
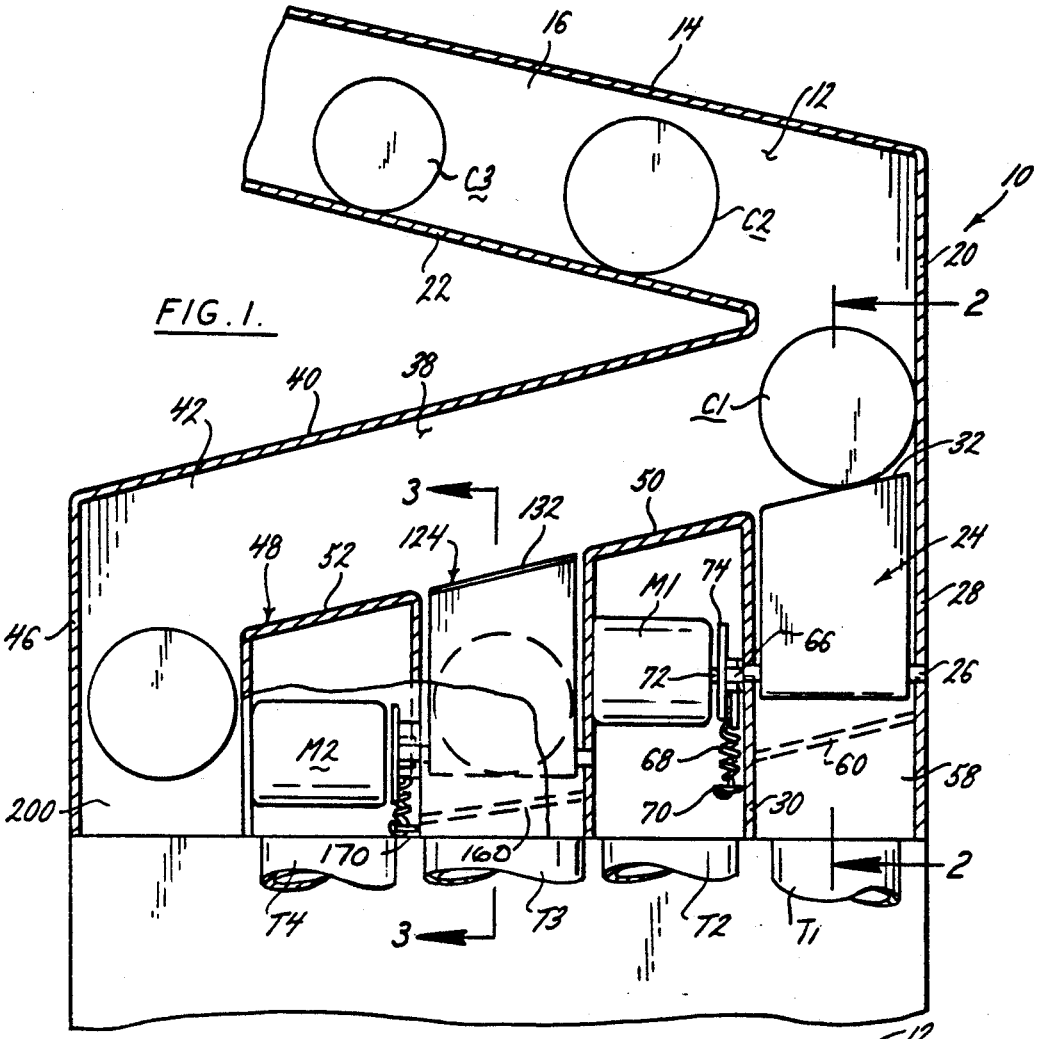
FIG. 1 is an elevational view of a coin guiding device.
Figure 3:
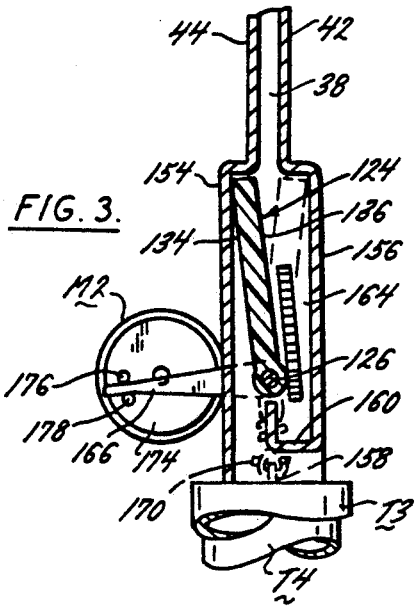
FIG. 3 is a cross sectional view taken on line 3—3 of FIG. showing a second, similar gate in another position.
Figure 2:
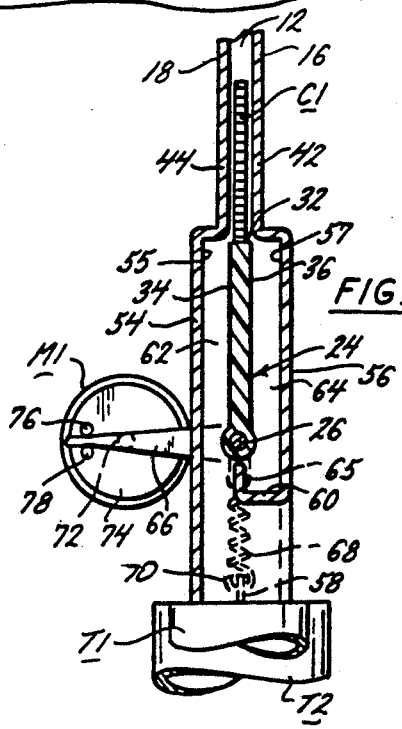
FIG. 2 is a cross sectional view taken on line 2—2 of FIG. showing a first gate in a neutral position.

DESCRIPTION OF THE PREFERRED EMBODIMENTS:

Referring now by reference numerals to the drawings and first to FIGS. 1-3 it will be understood that the coin guiding device generally indicated by numeral 10 includes a passage 12 constituting a coin delivery path. The passage 12 is defined by upper wall 14, rear wall 16, front wall 18, end wall 20 and bottom wall 22, said bottom wall 22 providing a rail surface for coins C1, C2 and C3. The passage 12 directs coins such as coin C1 onto a generally rectangular and flat pivoted gate 24, constituting a movable element having a pivot shaft 26 at the lower end pivotally supported by side walls 28 and 30. Gate 24, as best shown in FIG. 2 includes a coin-guiding upper edge 32 and opposed coin-guiding faces 34 and 36. Gate 24 upper edge 32 forms part of a first primary discharge passage 38, which is also defined by upper wall 40, rear wall 42, front wall 44, end wall 46 and bottom wall 48. The bottom wall 48 is formed in part by wall portions 50 and 52 and the upper edge 132 of a gate 124, which is similar to gate 24. Wall portions 50 and 52 and upper edge 132 cooperate to provide a rail surface for selected coins.

As shown in FIG. 2, gate 24 is disposed between front and rear walls 54 and 56, which cooperate with intermediate wall 58 and bottom wall 60, respectively, to define second and third primary discharge passages 62 and 64 leading, for example, to coin tubes T1 and T2. At its lower end gate 24 includes a bell crank arm 66, the inner end of which includes a lug 65 connected to a tension spring 68. The spring is attached to bracket 70 and shown, in FIG. 2, in its vertical, neutral position. The arm 66 is moved clockwise and counterclockwise by means of a reversible electric motor M1, constituting a moving means, having shaft means 72 provided with a disc 74. The disc includes offset pegs 76 and 78 which are engageable with arm 66 to move said gate 24 clockwise to guide coins into passage 62 or counterclockwise to guide coins into passage 64. By this structural arrangement of parts motor M1 and spring 68 cooperate to provide a means of actuating gate 24 from a neutral position, in which coins are guided into passage 38 along the upper edge 32 of gate 24, or into one or the other inclined positions. When the gate 24 is moved clockwise, coins are guided into passage 62 by engagement with guide face 34 and thence into coin tube T1. Alternatively, when the gate 24 is moved counterclockwise, coins are guided into passage 64 by engagement with guide face 36 and thence into coin tube T2. When power is cut off the gate returns to its neutral, vertical position by the spring which provides a biasing means.

In the event that a coin is directed into passage 38 it proceeds along the rail surface provided by wall portion 50. When gate 124 is reached the coin will be guided into one of three paths depending on the position of gate 124. With gate 124 in the vertical or neutral position the coin will continue down passage 38 along the rail surface provided by wall portions 52 and thence into passage 200 and return to customer. With gate 124 in the counterclockwise position, shown in full lines in FIG. 3, the coin is guided by engagement with guide face 136 into passage 164, defined by walls 156 and 160, and thence into coin tube T4. With gate 124 in the clockwise position shown in phantom outline in FIG. 3 the coin is guided by engagement with guide face 134 into passage 162, defined by walls 154 and wall 158 and thence into coin tube T3. It will be understood that gates 24 and 124, motors M1 and M2 and the walls defining related passage parts are similar or identical and that similar parts relating to gate 124 bear similar numbers to those relating to gate 24 with the addition of prefix numeral 1. Wall portions 55 and 57 adjacent to the upper end of gate 24 are used as stops to determine the limit of movement by engagement by said gate. When power is cut off the gate returns to its vertical, neutral position and coins are delivered to customer return passage 200.

The remaining FIGS. 4-24 show modified gate and actuating means which are shown as alternative embodiments to first gate 24. These alternative embodiments could, however, also be used for the second gate 124. In the drawing figures for these embodiments, similar parts are, in general, identified by similar numerals to those used in FIGS. 1 and 2 with the addition of a prefix numeral.

Figure 4:
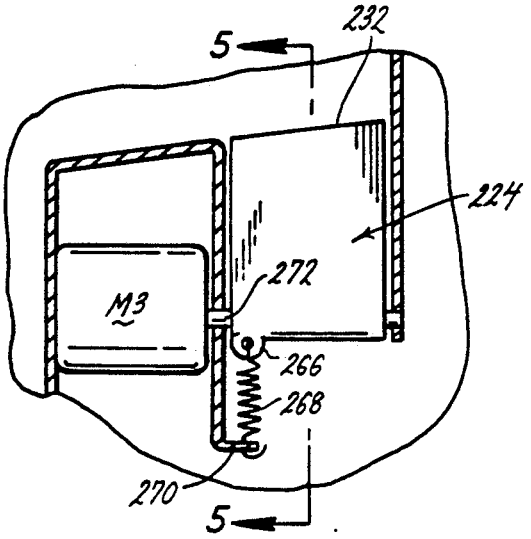
FIG. 4 is a fragmentary view of a modified coin guiding device.
Figure 5:
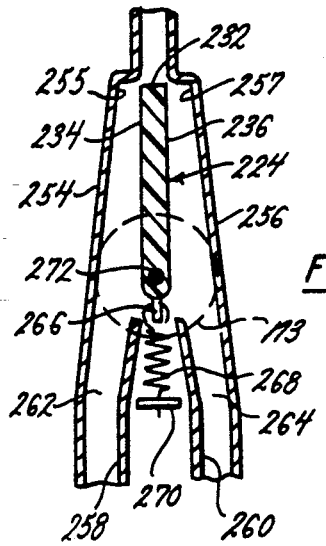
FIG. 5 is a cross sectional view taken on line 5—5 of FIG. showing the gate in a neutral position.

FIGS. 4 and 5 show a gate 224 having an upper guide edge 232 and opposed guide faces 234 and 236 positioned between walls 254 and 256 which cooperate with walls 258 and 260, respectively, to define passages 262 and 264. Gate 224 includes a lug 266 which is connected by a tension spring 268 to a support 270 and which can be of greater length if more end movement is required. The tension spring 268 tends to maintain the gate 224 in the neutral position shown in FIG. 5 and said gate is moved into clockwise and counterclockwise positions to guide coins into passages 262 and 264, respectively, by means of a reversible electric motor M3. Wall portions 255 and 257 determine the limit of movement of gate 224.

Figure 6:
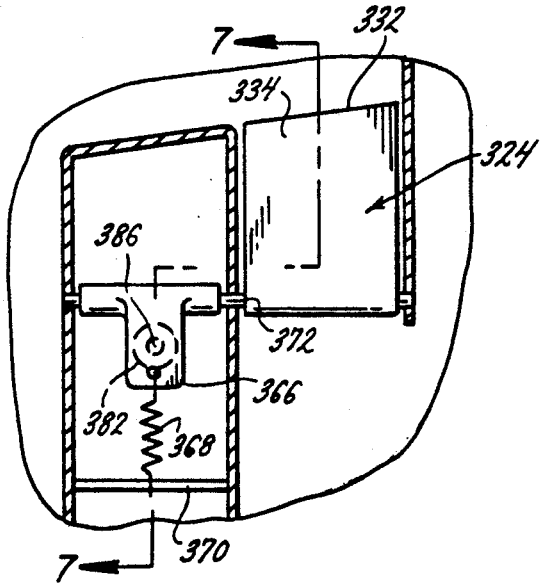
FIG. 6 is a fragmentary view of another modified coin guide device.
Figure 7:
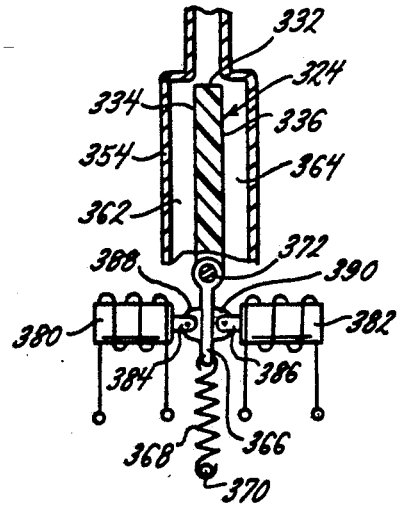
FIG. 7 is a cross sectional view taken on line 7—7 of FIG. showing the gate in a neutral position.
Figure 13:
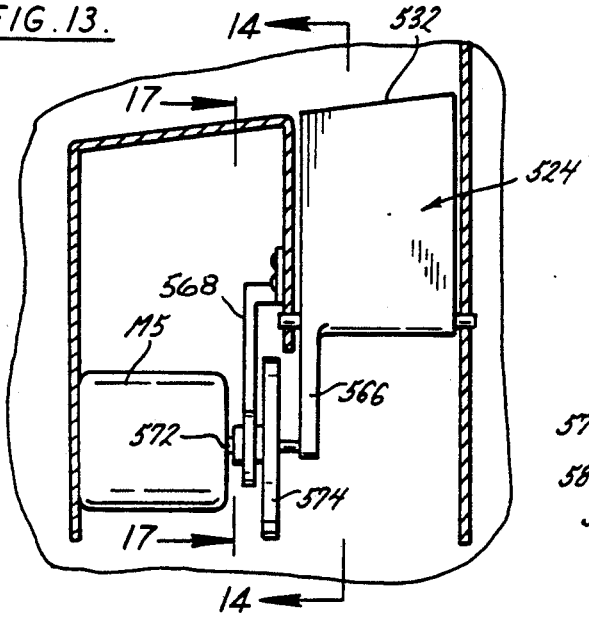
FIG. 13 is a fragmentary view of another modified coin guiding device.
Figure 14:
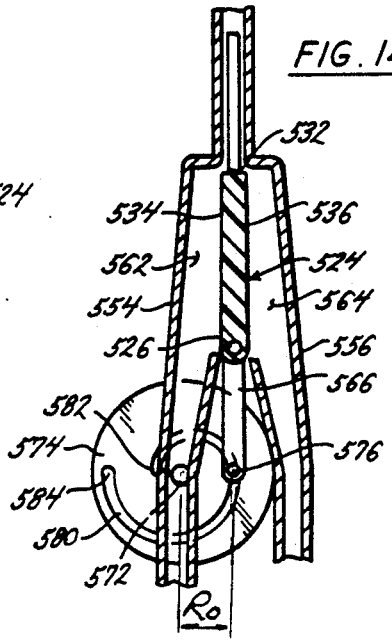
FIG. 14 is a cross sectional view taken on line 14—14 of FIG. 13 showing the gate in a neutral position.

FIGS. 6 and 7 show a gate 324 having an upper guide edge 332 and opposed guide faces 334 and 336 positioned between walls 354 and 356 which cooperate with walls 354 and 356, respectively, to form passages 362 and 364. Gate 324 includes an extended pivot shaft 372 having an arm 366 fixedly attached to said pivot shaft 372 to rotate said gate. The arm 366 is connected by a tension spring 368 to a support 370. The tension spring 368 tends to maintain the gate 324 in the neutral position shown in FIG. 7 and said gate is moved into clockwise and counterclockwise positions to guide coins into passages 362 and 364, respectively, by means of solenoids 380 and 382, constituting moving means. The solenoids 380 and 382 include armatures 384 and 386 which are pivotally connected at their ends to suitably apertured lugs 388 and 390. When one solenoid is actuated the core pulls the unactuated solenoid core axially with it by virtue of the pivotal connection. The upper portions of walls 454 and 456 provide stop means.

FIGS. 8–12 show a gate 424 having upper guide edge 432 and opposed guide faces 434 and 436 positioned between walls 454 and 456, which cooperate with said walls 454 and 456, respectively, to form passages 462 and 464. Gate 424 includes pivot shaft 426 and an arm 466 which is aligned with said gate. The arm 466 is connected by a tension spring 468 to a support 470. The gate 424 is moved into two clockwise positions by an electric motor which is connected to the arm 466 by means of a disc 474 attached to the motor shaft 472, said disc including three (3) pegs 476, 478 and 480 which are selectively engageable with the arm 466. The manner in which the motor M4 and pegs 476, 478 and 480 cooperate to move the gate 424 into the inclined positions shown in FIGS. 9 and 10 respectively, and the vertical position shown in FIG. 11 will be described with particular reference to FIG. 12 which is an enlarged composite schematic of the gate 424 in each of the three positions. The first position (1) is shown in dotted lines, the second position (2) in phantom lines and the third position (3) is shown in full lines. Essentially, the gate 424 is moved from the rest position 1) into the two clockwise positions (2 and (3) by counterclockwise and clockwise rotation, respectively, of the motor M4 because of relative positions of the axis of rotation of the gate, which is the pivot axis 426, and the axis of rotation of the motor M4.

When the electric motor M4 is in the rest position shown in FIG. 9, and designated by (1) in FIG. 12, the arm 466 is engaged by pegs 476 and 478 under minimum spring tension and coins are guided into passage 464, typically the coin return passage. In this rest position the arm is engaged by pegs 476 and 478 but not by peg 480 and the motor is not energized so that the light spring tension tends to maintain the gate 424 in the inclined position shown in FIG. 9. Gate 424 is also engaged by the upper portion of wall 454 which provides stop means.

When the motor M4 is actuated to rotate the disc 474 counterclockwise, peg 476 moves the arm 466, and therefore the gate 424, clockwise into the inclined position (2) shown in FIG. 10. In this position gate 424 is also engaged by the upper portion of wall 456 which provides stop means, the arm is under maximum spring tension and coins are guided into passage 462. As shown in FIG. 10 peg 478 has moved out of engagement with arm 466. When power is cut off the gate 424 returns to the rest position in which coins directed to the customer return passage 464.

When it is desired to guide coins along the gate upper guide edge 432 the motor M4 is actuated to rotate the disc 474 clockwise. Clockwise rotation of the disc 474 from the rest position rotates the arm 466 and therefore the gate 424 clockwise and this rotation continues until peg 480 also engages the arm 466 and no further rotation of the arm is possible, the arm being trapped between pegs 478 and 480 as shown in FIG. 11. The pegs 478 and 480 are arranged on the disc so that when they both engage the arm, the gate assumes a vertical orientation and the arm is under intermediate spring tension. In this position coins are guided along the coin upper edge 432 into passage 38. When power is cut off the gate 424 again returns to the rest position.

Figure 15:
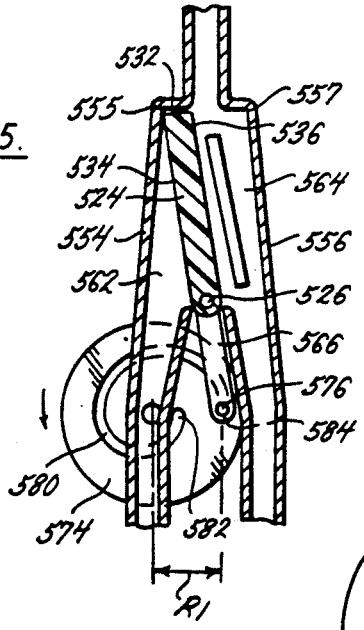
FIG. 15 is a similar view to FIG. 14 showing the gate in another position.
Figure 16:
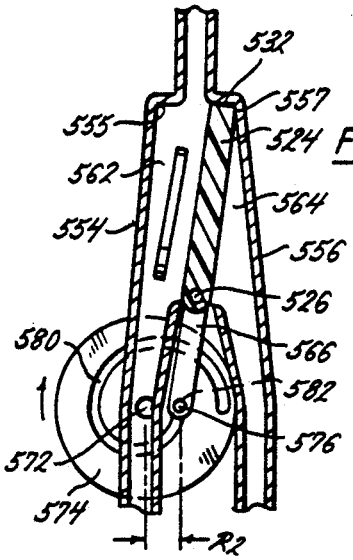
FIG. 16 is a similar view to FIG. 14 showing the gate in another position.

FIGS. 13–17 show a gate 524 having an upper guide edge 532 and opposed guide faces 534 and 536 positioned between walls 554 and 556, which cooperate with said walls 554 and 556 to form passages 562 and 564. Gate 524 includes pivot shaft 526 and an arm 566 which is aligned with said gate and includes a guide pin 576 at its lower end. The gate 524 is moved from a vertical position into two inclined positions by means of a reversible electric motor M5 which is connected to the arm 566 by means of a cam disc 574 attached to the motor shaft 572 having a three hundred and sixty degree (360°) spiral cam groove 580 which receives the guide follower pin 576 therein and has opposite inner and outer ends 582 and 584 respectively. The disc 574 is maintained in the rest position shown in FIG. 14 by means of a torsion spring 568 which is attached at one end to a support 570 and at the other end to the disc 574. The axis of the motor shaft 572 is offset from the vertical axis of the gate 524 and arm 566 by radial distance R0 which is the radius of the spiral groove for this position. When the motor M5 is actuated to rotate the disc 574 counterclockwise through one hundred and eighty degrees (180°), as shown in FIG. 15, the guide pin 576 engages the outer end 584 of the groove 580, which limits further movement of the gate 524, and the gate 524 is one inclined position. In this inclined position the radial distance of the pin 576 from the axis of rotation of the motor M5 is $R_1$, which is the radius of the spiral groove for this position. When power is cut off, the torsion spring 568 returns the disc 574, and therefore the gate 524, to the neutral, vertical position. When the motor M5 is actuated to rotate the disc 574 clockwise through one hundred and eighty degrees (180°) as shown in FIG. 16, the guide pin 576 engages the inner end 582 of the groove 580, which limits further movement of the gate 524, and the gate 524 is in the other inclined position. In this inclined position the radial distance of the pin 576 from the axis of rotation of the motor M5 is $R_2$ which is the radius of the spiral groove for this position. When power is cut off, the torsion spring again returns the gate 524 to the neutral position.

In the embodiment shown, the horizontal distance moved by the pin for each inclined position is the same. Accordingly: $R_1-R_0=R_0-R_2$ and $R_0$ is equal to $(R_1+R_2)\times\frac{1}{2}$.

It will be understood that in lieu of using pin engagement with the ends of the groove, wall portions 555 and 557 adjacent the upper end of the gate 524, could be used as stops to determine the limit of movement by engagement by said gate.

FIGS. 18–23 show a gate 624 having an upper guide edge 632 and opposed guide faces 634 and 636 positioned between walls 654 and 656, which cooperate with said walls 654 and 656 to form passages 662 and 664. Gate 624 includes pivot shaft 626 at its lower end and a guide pin 676 at its upper end. The gate is moved from a neutral inclined position shown in FIG. 20 to another inclined position shown in FIG. 21 and a vertical position shown in FIG. 22 by a reversible electric motor M6 which is connected to the gate 624 by means of a cam cylinder 674 attached to the motor shaft 672 and having a three hundred and sixty degree (360°) surface cam groove 680. The cam groove 680 receives the guide follower pin 676 through a slot 677 provided in the wall 678 to which the motor M6 is mounted. The surface groove 680 is shown developed in FIG. 23 and includes opposed ends 682 and 684, and an apex 686. The two legs of the groove indicated by numerals 688 and 690 are substantially the same length, each extending an angular distance of one hundred and eighty degrees (180°) from the apex 686. The legs 688 and 690 are, however, angled differently to provide axial movement from the apex 686 to the groove end 682 of $L_1$ and axial movement from the apex 686 to the groove end 684 of $L_2$. In the embodiment shown $L_2=2L_1$.

Figure 17:
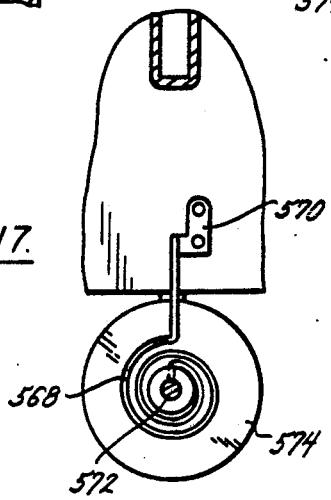
FIG. 17 is a view taken on line 17—17 of FIG. 13 showing a return spring arrangement.
Figure 18:
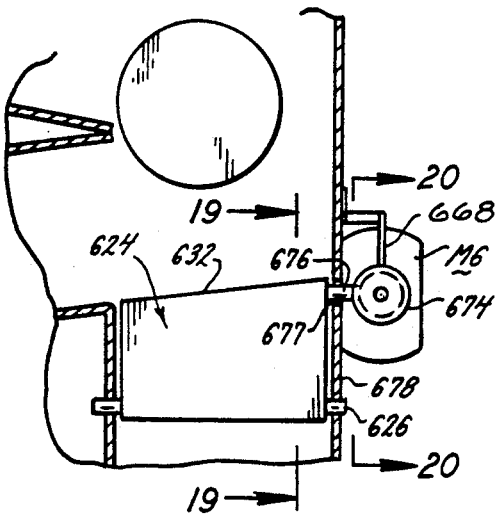
FIG. 18 is a fragmentary view of another modified coin guiding device.
Figure 19:
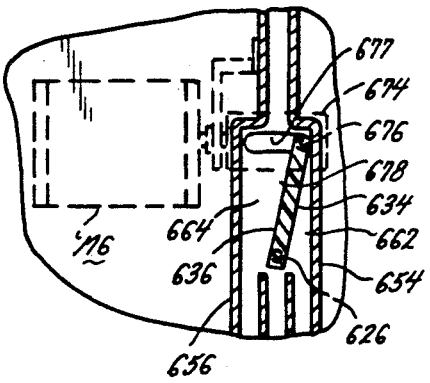
FIG. 19 is a cross sectional view taken on line 19—19 of FIG. 18 showing the gate in a neutral position.
Figure 21:
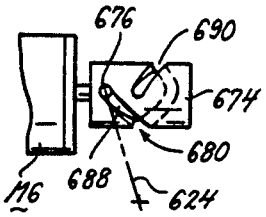
FIG. 21 is a similar view to FIG. 20 showing another position of the gate.
Figure 20:
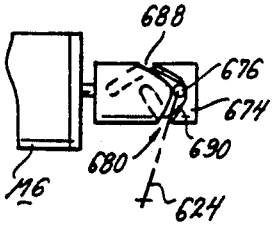
FIG. 20 is a simplified elevational view of the grooved cylinder showing one position of the gate.
Figure 22:
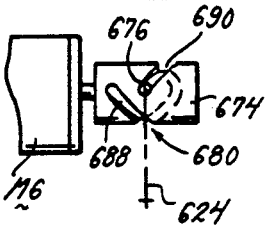
FIG. 22 is a similar view to FIG. 20 showing another position of the gate.
Figure 23:
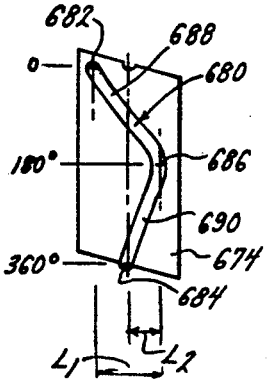
FIG. 23 is a somewhat schematic developed view of the surface of the cylinder cam showing the groove configuration.

This structural arrangement of parts provides that the gate 624 is inclined, as shown in FIG. 19 and FIG. 20, in the neutral position when power is off, under the action of a torsion spring 668, similar to that shown in FIG. 17. When the motor M6 is actuated to rotate the cylinder 674 counterclockwise through one hundred and eighty degrees (180°), the pin 676 is moved to engage the groove end 682 and the gate 624 is moved to the other inclined position, shown in FIG. 21. When power is cut off the gate 624 returns to the neutral, inclined position. When the motor M6 is actuated to rotate the cylinder 674 clockwise through one hundred and eighty degrees (180°), the pin 676 is moved to engage the groove end 682 and the gate 624 is moved to the vertical position shown in FIG. 22.

The advantage of the gate arrangement disclosed in FIGS. 18–22 is that in the neutral inclined position shown in FIGS. 19 and 20 coins will be automatically returned directly to customer when power is off. As with the previous embodiments the upper portions of walls 654 and 656 can be used as stop means.

Figure 24:
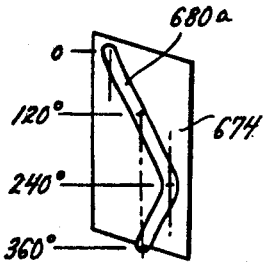
FIG. 24 is a similar view of a modified groove configuration.
Figure 25:
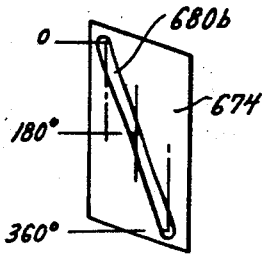
FIG. 25 is a similar view of another modified groove configuration.

It will be understood that the groove 680*a* could be arranged as two legs of unequal length but the same angle to provide equal axial movement for proportionate, opposite rotation of the cylinder as shown in FIG. 24. Alternatively, the groove 680*b* could be arranged as a single leg as shown in FIG. 25 with midpoint providing a vertical, neutral position of the gate with opposite rotation of the gate defining opposite inclinations. Other groove arrangements will also occur to those skilled in the art.

Although the coin guiding device has been described by making detailed reference to a preferred embodiment, the details of description are not to be understood as restrictive numerous variants being possible within the scope of the claims hereunto appended.

I claim as my invention:

1. A coin guiding device comprising:

(a) a coin delivery path, (b) first, second and third coin discharge paths, (c) a movable element disposed in the coin delivery path and having a coin supporting and guiding upper edge and opposed coin guiding faces, and (d) actuating means for selectively moving said movable element between a first position in which the upper coin supporting edge guides a coin into the first discharge path, a second position in which one of said opposed faces guides a coin into the second discharge path and a third position in which the other of said opposed faces guides a coin into said third discharge path.

2. A coin guiding device as defined in claim 1, in which:

(e) the movable element is a gate means having pivot means about which the gate pivots between said first, second and third positions.

3. A coin guiding device as defined in claim 2, in which:

(f) the actuating means includes a reversible electric motor operatively connected to said gate to pivot said gate means about said pivot means.

4. A coin guiding device as defined in claim 2, in which:

(f) the actuating means includes a solenoid means operatively connected to said gate to pivot said gate about said pivot means.

5. A coin guiding device as defined in claim 2, in which:

(f) the actuating means includes biasing means operatively connected to said gate means to maintain said gate in one of said first, second and third positions.

6. A coin guiding device as defined in claim 2, in which:

(f) the gate means includes a lever arm and said actuating means includes a moving means and means operatively connecting said lever arm to said moving means.

7. A coin guide device as defined in claim 6, in which:

(g) the lever arm is a bell crank.

8. A coin guiding device as defined in claim 2, in which:

(f) said actuating means includes a reversible electric motor having shaft means and said shaft means includes at least one offset portion operatively engageable with said gate means and providing said connecting means between the gate means and said motor.

9. A coin guiding device as defined in claim 2, in which:

(f) the actuating means includes an electric motor and cam means between said electric motor and said gate means for moving said gate means between said first, second and third positions.

10. A coin guiding device as defined in claim 9, in which:

(g) the cam means includes a cam mounted for rotation with said motor and a cam follower operatively attached to said gate means.

11. A coin guiding device as defined in claim 2, in which:

(f) the coin paths include wall portions providing stop means limiting movement of said gate means.

12. A coin guiding device as defined in claim 2, in which:

(f) the actuating means includes an electric motor and cam means between said electric motor and said gate means for moving said gate means between said first, second and third positions, and (g) the coin paths include wall portions providing stop means limiting movement of said gate means.

13. A coin guiding device comprising:

(a) a coin delivery path, (b) first, second and third coin discharge paths, (c) a movable element disposed in the coin delivery path and having a coin guiding upper edge and opposed coin guiding faces, and (d) actuating means for selectively moving said movable element between a first position in which the upper edge guides a coin into the first discharge path, a second position in which one of said opposed faces guides a coin into the second discharge path and a third position in which the other of said opposed faces guides a coin into said third discharge path, (e) the movable element being a gate means having pivot means about which the gate pivots between said first, second and third positions, and (f) the actuating means including an electric motor means and a plurality of pins offset from the axis of rotation of the motor means, said pins being selectively engageable with said gate means to move said gate means between said first, second and third positions.

14. A coin guiding device comprising:

(a) a coin delivery path, (b) first, second and third coin discharge paths, (c) a movable element disposed in the coin delivery path and having a coin guiding upper edge and opposed coin guiding faces, and (d) actuating means for selectively moving said movable element between a first position in which the upper edge guides a coin into the first discharge path, a second position in which one of said opposed faces guides a coin into the second discharge path and a third position in which the other of said opposed faces guides a coin into said third discharge path, (e) the movable element being a gate means having pivot means about which the gate pivots between said first, second and third positions, (f) the actuating means includes an electric motor and cam means between sid electric motor and said gate means for moving said gate means between said first, second and third positions, (g) the cam means includes a cam mounted for rotation with said motor and a cam follower operatively attached to said gate means, and (h) the cam including a face provided with a cam groove and the cam follower being a pin attached to said gate means in spaced relation to said pivot mans and received by sid groove,.

15. A coin guiding device as defined in claim 14, in which:

(i) the cam groove includes ends engageable by said pin to provide stop means limiting movement of said gate means.

16. A coin guiding device as defined in claim 14, in which:

(i) the cam face is substantially flat and is provided by a disc rotatable by the motor means.

17. A coin guiding device as defined in claim 14, in which:

(i) the cam face is arcuate and is provided by a cylinder rotatable by the motor.

18. A coin device comprising:

(a) a coin delivery path, (b) first second and third primary coin discharge paths, (c) a first movable element disposed in said coin delivery path and having a coin supporting and guiding upper edge and opposed coin guiding faces, (d) first actuating means for selectively moving said first movable element between a first position in which the coin supporting upper edge guides a coin into said first primary discharge path, a second position in which one of said opposed faces guides a coin into said second primary discharge path and a third position in which the other of sid opposed faces guides a coin into said third primary discharge path, (e) first, second and third secondary discharge paths, (f) a second movable element disposed in one of said primary discharge paths and having a coin supporting and guiding upper edge and opposed coin guiding faces, and (g) second actuating means for selectively moving said second movable element between a first position in which the coin supporting upper edge guides a coin into said first secondary discharge path, a second position in which one of said opposed faces guides a coin into said second secondary discharge path and a third position in which the other of said opposed faces guides a coin into sid third secondary discharge path.

* * * * *